US008840703B1

(12) United States Patent
Heath et al.

(10) Patent No.: US 8,840,703 B1
(45) Date of Patent: Sep. 23, 2014

(54) LIQUID HYDROCARBON SLUG CONTAINING VAPOR RECOVERY SYSTEM

(76) Inventors: Rodney T. Heath, Farmington, NM (US); Forrest D. Heath, Katy, TX (US); Gary Heath, Farmington, NM (US)

( * ) Notice: Subject to any disclaimer, the term of this patent is extended or adjusted under 35 U.S.C. 154(b) by 180 days.

(21) Appl. No.: 13/357,367

(22) Filed: Jan. 24, 2012

Related U.S. Application Data

(63) Continuation of application No. 12/043,685, filed on Mar. 6, 2008, now Pat. No. 8,529,215.

(51) Int. Cl.
*B01D 19/00* (2006.01)

(52) U.S. Cl.
USPC ..... 95/24; 95/247; 95/250; 95/266; 95/17; 95/18; 96/193; 96/201; 96/157; 96/173

(58) Field of Classification Search
USPC ..... 95/247, 250, 266, 17, 18, 24; 96/193, 96/201, 157, 173
See application file for complete search history.

(56) References Cited

U.S. PATENT DOCUMENTS

| | | | | |
|---|---|---|---|---|
| 844,694 | A | 2/1907 | Smith | |
| 1,903,481 | A | 4/1933 | Schweisthal | |
| 2,225,959 | A | 12/1940 | Miller | |
| 2,726,729 | A | 12/1955 | Williams | |
| 2,738,026 | A | 3/1956 | Glasgow et al. | |
| 2,765,872 | A | 10/1956 | Hartman et al. | |
| 2,786,543 | A | 3/1957 | Hayes et al. | |
| 2,812,827 | A | 11/1957 | Worley et al. | |
| 2,815,901 | A | 12/1957 | Hale | |
| 2,853,149 | A | 9/1958 | Gosselin | |
| 2,937,140 | A * | 5/1960 | Stinson | 208/340 |
| 2,970,107 | A * | 1/1961 | Gilmore | 208/361 |
| 2,984,360 | A | 5/1961 | Smith | |
| 3,018,640 | A | 1/1962 | Heller et al. | |
| 3,025,928 | A | 3/1962 | Heath | |
| 3,027,651 | A | 4/1962 | Nerge | |
| 3,094,574 | A | 6/1963 | Glasgow et al. | |
| 3,105,855 | A | 10/1963 | Meyers | |
| 3,152,753 | A | 10/1964 | Adams | |
| 3,182,434 | A | 5/1965 | Fryar | |
| 3,237,847 | A | 3/1966 | Wilson | |

(Continued)

FOREIGN PATENT DOCUMENTS

| | | |
|---|---|---|
| AR | 011862 | 9/2000 |
| AR | 024366 | 10/2002 |

(Continued)

OTHER PUBLICATIONS

RU 21599913 C1 Abstract; Nov. 27, 2000; Russian Federation; Kirillov.

(Continued)

*Primary Examiner* — Duane Smith
*Assistant Examiner* — Douglas Theisen
(74) *Attorney, Agent, or Firm* — Peacock Myers, P.C.; Deborah A. Peacock; Justin R. Jackson

(57) ABSTRACT

A liquid hydrocarbon slug-containing vessel for incorporation into a system integrating a low-pressure separator with a vapor recovery process system, and a method for regulating the temperature of a gas to be compressed by a two stage compressor so as to prevent liquification of the gas and to prevent over-heating of the compressor.

19 Claims, 3 Drawing Sheets

(56) References Cited

U.S. PATENT DOCUMENTS 3,254,473 A 6/1966 Fryar et al.
3,255,573 A 6/1966 Cox, Jr. et al.
3,288,448 A 11/1966 Patterson et al.
3,321,890 A 5/1967 Barnhart
3,347,019 A 10/1967 Barnhart
3,360,127 A 12/1967 Wood, Jr.
3,396,512 A 8/1968 McMinn et al.
3,398,723 A 8/1968 Smalling
3,407,052 A 10/1968 Huntress et al.
3,528,758 A 9/1970 Perkins
3,540,821 A 11/1970 Siegmund
3,541,763 A 11/1970 Heath et al.
3,589,984 A 6/1971 Reid
3,616,598 A 11/1971 Floral, Jr.
3,648,434 A 3/1972 Graves, III et al.
3,659,401 A 5/1972 Giammarco
3,672,127 A 6/1972 Mayse et al.
3,736,725 A 6/1973 Alleman et al.
3,817,687 A 6/1974 Cavallero et al.
3,829,521 A 8/1974 Green
3,855,337 A 12/1974 Foral, Jr. et al.
3,872,682 A 3/1975 Shook
3,949,749 A 4/1976 Stewart
3,989,487 A 11/1976 Peterson
4,009,985 A 3/1977 Hirt
4,010,009 A 3/1977 Moyer
4,010,065 A 3/1977 Alleman
4,058,147 A 11/1977 Stary et al.
4,098,303 A 7/1978 Gammell
4,108,618 A 8/1978 Schneider
4,118,170 A 10/1978 Hirt
4,134,271 A 1/1979 Datis
4,162,145 A 7/1979 Alleman
4,198,214 A 4/1980 Heath et al.
4,270,938 A 6/1981 Schmidt et al.
4,286,929 A 9/1981 Heath et al.
4,305,895 A 12/1981 Heath et al.
4,322,265 A 3/1982 Wood
4,332,643 A 6/1982 Reid
4,342,572 A 8/1982 Heath
4,362,462 A 12/1982 Blotenberg
4,369,049 A 1/1983 Heath
4,396,371 A 8/1983 Lorenz et al.
4,402,652 A 9/1983 Gerlach et al.
4,421,062 A 12/1983 Padilla, Sr.
4,431,433 A 2/1984 Gerlach et al.
4,435,196 A 3/1984 Pielkenrood
4,459,098 A 7/1984 Turek et al.
4,462,813 A 7/1984 May et al.
4,474,549 A 10/1984 Capone
4,474,550 A 10/1984 Heath et al.
4,493,770 A 1/1985 Moilliet
4,501,253 A 2/1985 Gerstmann et al.
4,505,333 A 3/1985 Ricks
4,511,374 A 4/1985 Heath
4,539,023 A 9/1985 Boley
4,568,268 A 2/1986 Gerlach et al.
4,579,565 A 4/1986 Heath
4,583,998 A 4/1986 Reid et al.
4,588,372 A 5/1986 Torborg
4,588,424 A 5/1986 Heath et al.
4,597,733 A 7/1986 Dean et al.
4,615,673 A 10/1986 Heath et al.
4,617,030 A 10/1986 Heath
4,659,344 A 4/1987 Gerlach et al.
4,674,446 A 6/1987 Padilla, Sr.
4,676,806 A 6/1987 Dean et al.
4,689,053 A 8/1987 Heath
4,701,188 A 10/1987 Mims
4,715,808 A 12/1987 Heath et al.
4,737,168 A 4/1988 Heath
4,778,443 A * 10/1988 Sands et al. ..... 494/31
4,780,115 A 10/1988 Ranke
4,824,447 A 4/1989 Goldsberry
4,830,580 A 5/1989 Hata et al.
4,919,777 A 4/1990 Bull
4,948,393 A * 8/1990 Hodson et al. ..... 95/250
4,949,544 A 8/1990 Hines
4,978,291 A 12/1990 Nakai
4,983,364 A 1/1991 Buck et al.
5,080,802 A 1/1992 Cairo, Jr. et al.
5,084,074 A 1/1992 Beer et al.
5,129,925 A 7/1992 Marsala et al.
5,130,078 A 7/1992 Dillman
5,132,011 A 7/1992 Ferris
5,163,981 A 11/1992 Choi
5,167,675 A 12/1992 Rhodes
5,191,990 A 3/1993 Fritts
5,195,587 A 3/1993 Webb
5,209,762 A 5/1993 Lowell
5,249,739 A 10/1993 Bartels et al.
5,269,886 A 12/1993 Brigham
5,346,537 A 9/1994 Lowell
5,377,723 A 1/1995 Hillard, Jr. et al.
5,419,299 A 5/1995 Fukasawa et al.
5,453,114 A 9/1995 Ebeling
5,476,126 A 12/1995 Hillard, Jr. et al.
5,490,873 A 2/1996 Behrens et al.
5,501,253 A 3/1996 Weiss
5,513,680 A 5/1996 Hillard, Jr. et al.
5,536,303 A 7/1996 Ebeling
5,571,310 A 11/1996 Nanaji
5,579,740 A 12/1996 Cotton et al.
5,664,144 A 9/1997 Yanai et al.
5,665,144 A 9/1997 Hill et al.
5,678,411 A 10/1997 Matsumura et al.
5,755,854 A 5/1998 Nanaji
5,766,313 A 6/1998 Heath
5,826,433 A 10/1998 Dube
5,857,616 A 1/1999 Karnoff et al.
5,878,725 A 3/1999 Osterbrink
5,882,486 A 3/1999 Moore
5,885,060 A 3/1999 Cunkelman et al.
5,988,232 A 11/1999 Koch et al.
6,004,380 A 12/1999 Landreau et al.
6,010,674 A 1/2000 Miles et al.
6,023,003 A 2/2000 Dunning et al.
6,027,311 A 2/2000 Hill et al.
6,095,793 A 8/2000 Greeb
6,142,191 A 11/2000 Sutton et al.
6,183,540 B1 2/2001 Thonsgaard
6,193,500 B1 2/2001 Bradt et al.
6,223,789 B1 5/2001 Koch
6,224,369 B1 5/2001 Moneyhun
6,238,461 B1 5/2001 Heath
6,251,166 B1 6/2001 Anderson
6,273,937 B1 8/2001 Schucker
6,299,671 B1 10/2001 Christensen
6,314,981 B1 11/2001 Mayzou et al.
6,332,408 B2 12/2001 Howlett
6,363,744 B2 4/2002 Finn et al.
6,364,933 B1 4/2002 Heath
6,425,942 B1 7/2002 Forster
6,461,413 B1 10/2002 Landreau et al.
6,478,576 B1 11/2002 Bradt et al.
6,499,476 B1 12/2002 Reddy
6,532,999 B2 3/2003 Pope et al.
6,533,574 B1 3/2003 Pechoux
6,537,349 B2 3/2003 Choi et al.
6,537,458 B1 3/2003 Polderman
6,551,379 B2 4/2003 Heath
6,604,558 B2 8/2003 Sauer
6,616,731 B1 9/2003 Hillstrom
6,719,824 B1 4/2004 Bowser
6,745,576 B1 6/2004 Granger
6,931,919 B2 8/2005 Weldon
6,984,257 B2 1/2006 Heath et al.
7,005,057 B1 2/2006 Kalnes
7,025,084 B2 4/2006 Perry et al.
7,131,265 B2 11/2006 Lechner
RE39,944 E 12/2007 Heath
7,350,581 B2 4/2008 Wynn
7,481,237 B2 1/2009 Jones et al.
7,497,180 B2 3/2009 Karlsson et al.

(56) References Cited

U.S. PATENT DOCUMENTS

| | | | | |
|---|---|---|---|---|
| 7,531,030 | B2 | 5/2009 | Heath et al. | |
| 7,575,672 | B1 | 8/2009 | Gilmore | |
| 7,905,722 | B1 | 3/2011 | Heath et al. | |
| 8,529,215 | B2 | 9/2013 | Heath et al. | |
| 2001/0008073 | A1 | 7/2001 | Finn et al. | |
| 2002/0073843 | A1 | 6/2002 | Heath | |
| 2002/0081213 | A1 | 6/2002 | Takahashi et al. | |
| 2002/0178918 | A1 | 12/2002 | Lecomte et al. | |
| 2002/0185006 | A1 | 12/2002 | Lecomte et al. | |
| 2003/0005823 | A1 | 1/2003 | Le Blanc et al. | |
| 2003/0167690 | A1 | 9/2003 | Edlund et al. | |
| 2004/0031389 | A1 | 2/2004 | Heath et al. | |
| 2004/0186630 | A1 | 9/2004 | Shier et al. | |
| 2004/0211192 | A1 | 10/2004 | Lechner | |
| 2005/0115248 | A1 | 6/2005 | Koehler et al. | |
| 2005/0266362 | A1 | 12/2005 | Stone et al. | |
| 2006/0144080 | A1 | 7/2006 | Heath et al. | |
| 2006/0156744 | A1 | 7/2006 | Cusiter et al. | |
| 2006/0156758 | A1 | 7/2006 | An et al. | |
| 2006/0218900 | A1 | 10/2006 | Lechner | |
| 2006/0254777 | A1 | 11/2006 | Wynn | |
| 2006/0260468 | A1 | 11/2006 | Amin | |
| 2007/0051114 | A1 | 3/2007 | Mahlanen | |
| 2007/0084341 | A1 | 4/2007 | Heath et al. | |
| 2007/0151292 | A1 | 7/2007 | Heath et al. | |
| 2007/0175226 | A1 | 8/2007 | Karlsson et al. | |
| 2007/0186770 | A1 | 8/2007 | Heath et al. | |
| 2007/0199696 | A1 | 8/2007 | Walford | |
| 2008/0008602 | A1 | 1/2008 | Pozivil et al. | |
| 2008/0120993 | A1 | 5/2008 | An et al. | |
| 2009/0133578 | A1* | 5/2009 | Bras et al. | 95/259 |
| 2009/0223246 | A1 | 9/2009 | Heath et al. | |
| 2010/0040989 | A1 | 2/2010 | Heath et al. | |
| 2012/0079851 | A1 | 4/2012 | Heath et al. | |
| 2012/0261092 | A1 | 10/2012 | Heath et al. | |
| 2013/0319844 | A1 | 12/2013 | Heath et al. | |

FOREIGN PATENT DOCUMENTS

| | | |
|---|---|---|
| CA | 2281610 | 9/1998 |
| CA | 2426071 | 10/2003 |
| CA | 2224389 | 2/2008 |
| CA | 2311440 | 6/2011 |
| CA | 2563747 | 5/2013 |
| FR | 2542039 | 9/1984 |
| GB | 370591 | 4/1932 |
| GB | 573819 | 12/1945 |
| JP | 58185990 | 10/1983 |
| RU | 2159913 | 11/2000 |
| SU | 1021809 | 6/1983 |
| SU | 1801092 | 3/1993 |
| WO | 2005068847 | 7/2005 |
| WO | 2010/080040 | 7/2010 |
| WO | 2013/170190 | 11/2013 |

OTHER PUBLICATIONS

"Environmental Technology Verification Report", Greenhouse Gas Technology Center Southern Research Institute.

"Natural Gas Dehydration", The Environmental Technology Verification Program, Sep. 2003.

Archer, Phil , "TEG Regenerator Vapor Recovery in Amoco's Northwestern Business Unit", Amoco Northwestern Business Unit, Aug. 1992.

Reid, Laurance S., "Coldfinger an Exhauster for Removing Trace Quantities of Water from Glycol Solutions Used for Gas Dehydration", Ball-Reid Engineers, Inc., Oklahoma City, Oklahoma, 1975, 592-602.

* cited by examiner

LIQUID HYDROCARBON SLUG CONTAINING VAPOR RECOVERY SYSTEM

CROSS-REFERENCE TO RELATED APPLICATIONS

This application is a continuation application of U.S. patent application Ser. No. 12/043,685, now issued as U.S. Pat. No. 8,529,215, entitled "Liquid Hydrocarbon Slug Containing Vapor Recovery System", to Rodney T. Heath, et al., filed on Mar. 6, 2008, and the specification and claims thereof are incorporated herein by reference.

BACKGROUND OF THE INVENTION

1. Field of the Invention (Technical Field)

The present invention relates to a stand-alone, liquid hydrocarbon slug-containing vapor recovery process system for application on natural gas well pads having either single or multiple wells.

2. Background Art

Natural gas production units can be can be integrated with the components (e.g., engine, emissions separator, circulating pump, educator, compressor, and controls) of a vapor recovery process system (referred to herein as a "VRSA") such as that described in U.S. patent application Ser. No. 11/677,985, now abandoned, entitled "Natural Gas Vapor Recovery Process System", filed Feb. 22, 2007 (the specification and claims of which are incorporated herein by reference). In such an integrated system, a vessel can be incorporated to contain a liquid hydrocarbon slug to relieve the VRSA from having to handle vapors derived from liquid hydrocarbons beyond its instant capacity to do so. Such a slug-containing vessel operates at the flowing line pressure and captures a liquid hydrocarbon slug upstream of the high pressure separator. Such an integrated system requires a slug-containing vessel for each well that produces liquid hydrocarbon slugs greater than the instant capacity of the VRSA.

However, because many of the applications of a VRSA are on well pads that have several natural gas wells, and the wells are already equipped with production units of various designs, a design is needed for a stand-alone, slug-containing VRSA that (limited only by the gas capacity of the compressor) could recover all the hydrocarbon vapors from the liquids produced by multiple wells on a well pad.

Note that where the discussion herein refers to a number of publications by author(s) and year of publication, that, due to recent publication dates, certain publications are not to be considered as prior art vis-à-vis the present invention. Discussion of such publications herein is given for more complete background and is not to be construed as an admission that such publications are prior art for patentability determination purposes.

BRIEF SUMMARY OF THE INVENTION

An embodiment of the present invention relates to a method for operating a two stage compressor including providing a compressor having a first stage and second stage, connecting an inlet of the first stage to a heater, and connecting an outlet of the first stage through a cooler that relies on external power. The cooler can include a heat exchanger that is at least partially immersed in produced fluids. In one embodiment, heat is generated, at least in part, by the first stage of the compressor. The heater and the cooler can be contained within a single unit.

In one embodiment, the heater maintains a temperature range for a gas passing through and/or entering the compressor at a temperature sufficient to prevent condensation and/or liquification of the gas in the compressor. Further, the cooler can maintain a temperature range for a gas passing through the compressor at a temperature sufficient to prevent thermal damage from occurring to the compressor. In one embodiment, the cooler can cool via conduction to produced fluids at a lower temperature. The effects of ambient air temperature on the heater and/or cooler can be reduced and/or eliminated.

An embodiment of the present invention relates to a method for handling a liquid hydrocarbon slug including a liquid hydrocarbon slug-containing vessel in communication with a natural gas well for receiving produced liquids, and a liquid level control in communication with a vapor recovery process system to cause the produced liquids to flow to the vapor recovery process system when the vapor recovery process system can accommodate vapors derived from the liquid hydrocarbons. The method can further include disposing a high pressure separator between, and in communication with, the natural gas well and the liquid hydrocarbon slug-containing vessel and/or disposing a low pressure separator between, and in communication with, the liquid hydrocarbon slug-containing vessel and the vapor recovery process system.

An embodiment of the present invention relates to an apparatus for containing a slug of liquid hydrocarbons collected in a natural gas well production unit or separator having a vessel, a liquid accumulator section of the vessel for communication with a low pressure separator, a liquid level control connected to the liquid accumulator section, the liquid level control including a valve for sending liquid hydrocarbons to the low pressure separator when a vapor recovery process system can receive gaseous hydrocarbons, and a gas container in communication with a high pressure separator. The apparatus can also have a first pipe in said low pressure separator, the first pipe heating a gas entering a first stage of a compressor when the gas temperature is cooler than desired. The apparatus can also have an output signal component in communication with the gas entering the first stage of the compressor. The output signal component can include a transducer, which can include a thermostat.

In one embodiment, the apparatus can include a second pipe in the low pressure separator, the second pipe cooling a gas discharged from the first stage of the compressor when the gas discharge temperature is hotter than desired. The apparatus can also include second output signal component in communication with the discharge gas exiting the first stage of the compressor and sensing whether the discharge gas is too hot. The second output signal component can include a transducer, which can include a thermostat. In the apparatus, the first pipe heats the gas entering the first stage of the compressor if the temperature of the gas is less than or about the same as a temperature at which the gas liquefies and/or condenses. In the apparatus, the second pipe cools the gas discharged from the first stage of the compressor if the temperature of the gas is greater than or about at a temperature at which compression of the gas by the second stage of the compressor would result in a temperature at or above that which would cause thermal damage to the compressor. Either or both of first and second pipes can include a heat exchanger incorporated therein or attached thereto.

An embodiment of the present invention also relates to a method for reducing energy consumption by heating a gas with thermal energy from produced fluids instead of another heat source.

Embodiments of the present invention provides for a vessel, and related components, for containing a slug of liquid hydrocarbons that are received from a natural gas well or wells of a natural gas production unit until a vapor recovery process system integrated into the production unit has the capacity to receive the liquid hydrocarbons and handle vapors that emanate from the liquid hydrocarbons.

Thus, an embodiment of the present invention provides a system having a vapor recovery process system in combination with a low-pressure separator, the system comprising a liquid hydrocarbon slug-containing vessel in communication with a high pressure separator installed on a natural gas well for receiving produced liquids and a liquid level control in communication with the vapor recovery process system and in communication with the liquid hydrocarbon slug-containing vessel to effect the flow of the produced liquids to the low-pressure separator and the evolved gases to the missions separator of the vapor recovery process system when the vapor recovery process system can accommodate vapors derived from the liquid hydrocarbons. The system further comprises a high pressure separator disposed between, and in communication with, the natural gas well and the liquid hydrocarbon slug-containing vessel. The system further comprises a low pressure separator disposed between, and in communication with, the liquid hydrocarbon slug-containing vessel and the vapor recovery process system.

Another embodiment of the present invention provides an apparatus for containing a slug of liquid hydrocarbons collected by a natural gas well high pressure separator, the apparatus comprising a vessel, a first boot (i.e., a liquid accumulator section) extending from a bottom of the vessel for immersion into the heated liquids contained in a low pressure separator and in communication with a vapor recovery process system, a liquid level control disposed in the first boot and in communication with a logic controller, a second boot (i.e., a gas dome) extending above a top of the vessel for communication with a high pressure separator in communication with a natural gas well, and a valve in communication with the liquid level control, the valve opening to send liquid hydrocarbons to the low pressure separator when the logic controller indicates that the vapor recovery process system can receive the liquid hydrocarbons. The apparatus further comprises a first pipe coil in the low pressure separator and immersed in produced liquids contained in the low pressure separator, the first pipe coil controlling a gas discharge temperature of a first stage of a compressor when the gas discharge temperature is cooler than desired. The apparatus further comprises an output signal component in communication with the discharge gas exiting the first compressor stage and sensing whether the discharge gas is too cool, the output signal component sending an output signal to control a first three-way splitter valve. The output signal component may comprise a transducer controlling an I/P or a thermostat. The apparatus further comprises a second pipe coil in the low pressure separator and immersed in liquids contained in the low pressure separator, the second pipe coil controlling a gas discharge temperature of the second stage of a compressor when the gas discharge temperature is hotter than desired. The apparatus has a second output signal component in communication with the discharge gas exiting the compressor and sensing whether the discharge gas is too hot, the second output signal component sending an output signal to a second three-way splitter valve. The second output signal component may comprise a transducer controlling an I/P or a thermostat.

Objects, advantages and novel features, and further scope of applicability of the present invention are set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention.

DETAILED DESCRIPTION OF THE INVENTION

An embodiment of the present invention provides for a vessel and system, for use with a vapor recovery process system (a "VRSA"), for containing a liquid hydrocarbon slug for those instances where the VRSA does not have the capacity to handle vapors, derived from liquid hydrocarbons, above a given amount.

As used herein, the words "a", "an", and "the" mean one or more. The same number labels in the figures are used consistently throughout for better understanding although such consistent use of numbering does not imply restriction to one embodiment.

Figure 1:
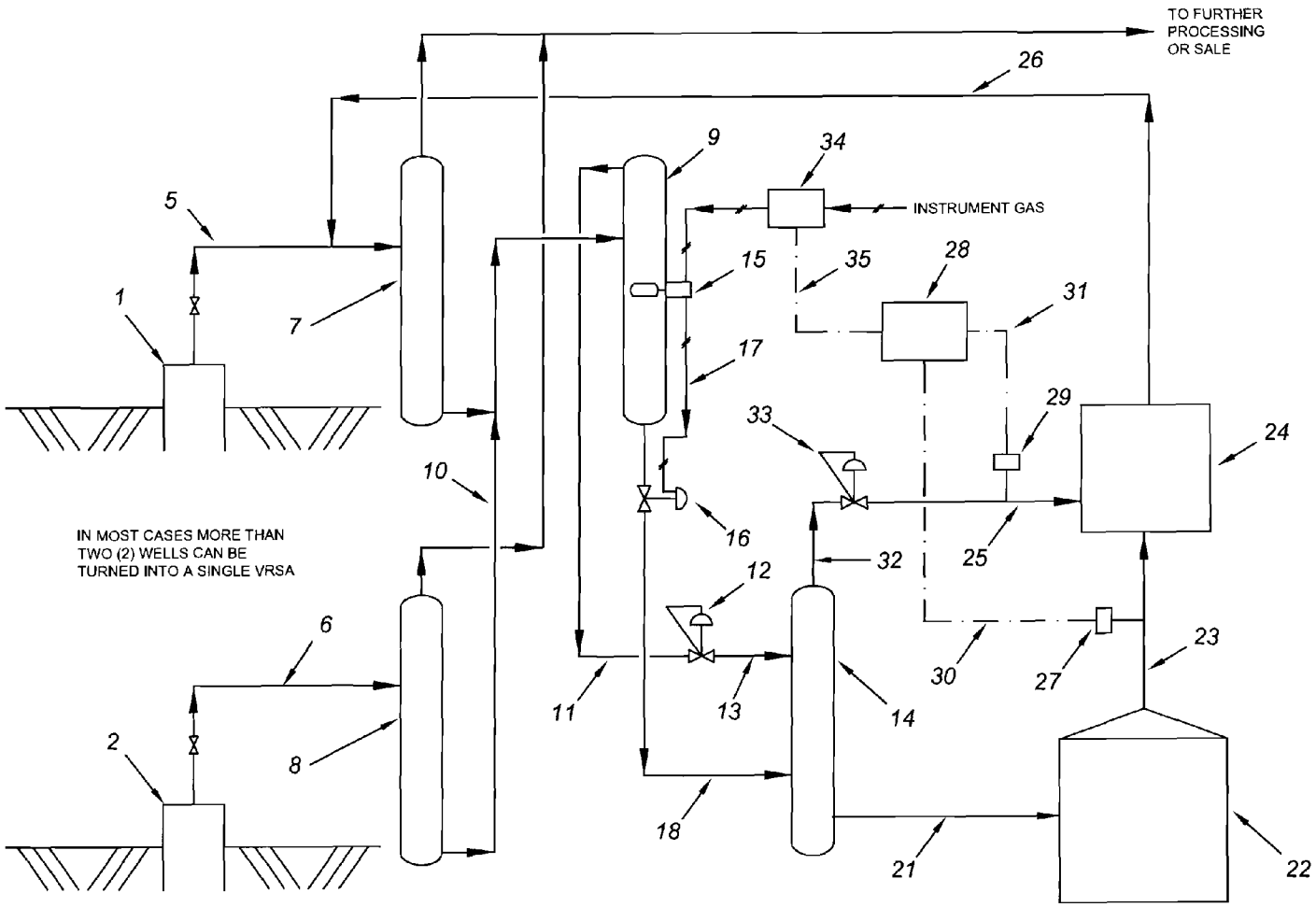
FIG. 1 is a flow diagram of a stand-alone, slug containing VRSA of an embodiment of the present invention.

Turning to the figures, FIG. 1 is a flow diagram of an embodiment of the stand-alone, slug-containing VRSA of the present invention. One or more natural gas wells may produce a liquid hydrocarbon slug that could exceed the capacity of VRSA 24 to handle the instantaneous volume of vapors created by the liquid hydrocarbon slug. In the embodiment illustrated in FIG. 1, natural gas wells 1 and 2 are in communication with high pressure separators 7 and 8 via well flow lines 5 and 6. High pressure separators 7 and 8 separate the produced natural gas from the produced liquids and may stand alone or be a part of a production unit. Liquids collected in high pressure separators 7 and 8 are transferred via dump line 10 to intermediate pressure liquid slug-containing vessel 9. Gases that evolve from the liquids being dumped into intermediate pressure slug containing vessel 9 are transferred to the inlet of backpressure regulator 12 via flow line 11.

Figure 2:
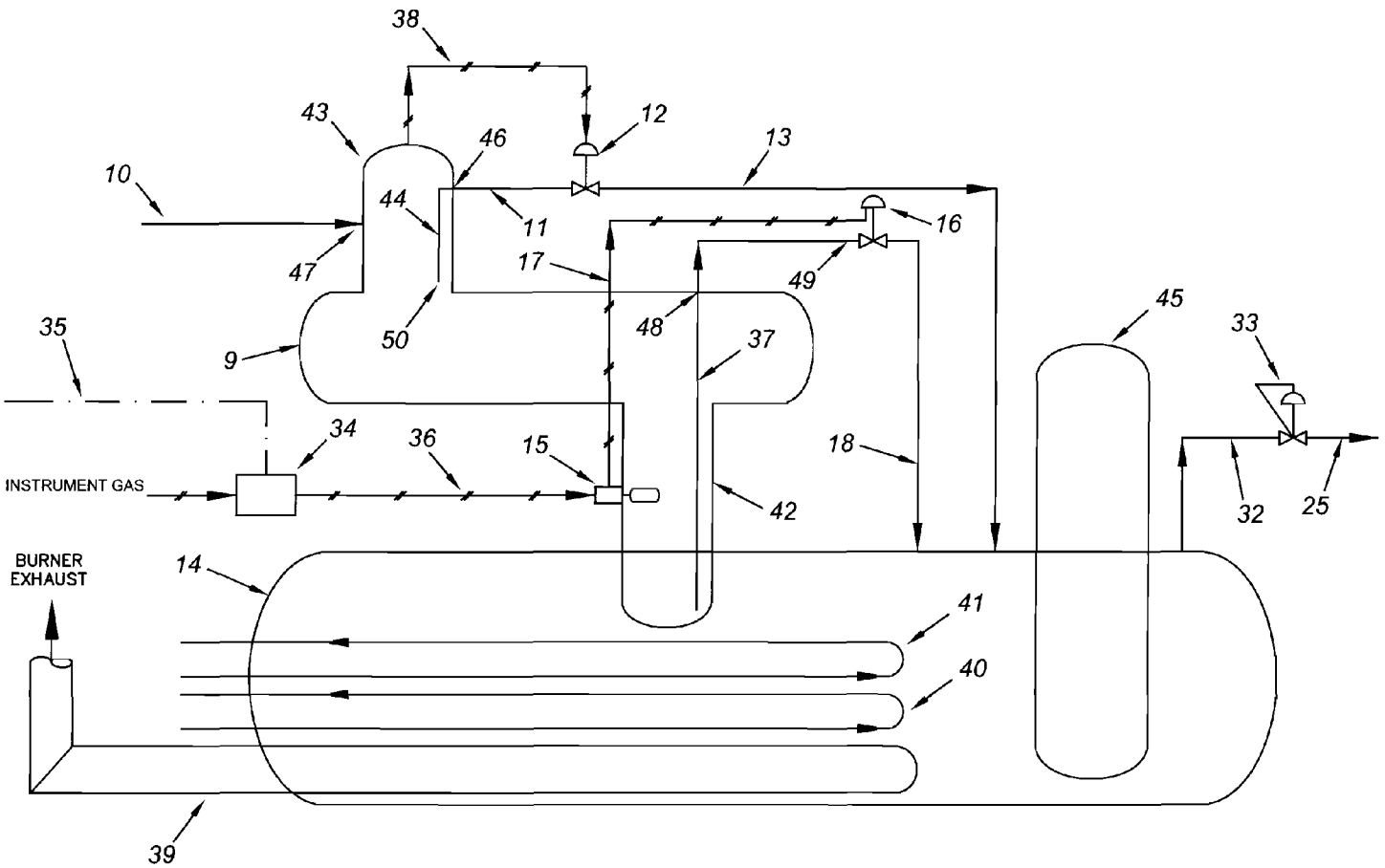
FIG. 2 is a schematic of a configuration of the intermediate pressure slug containing vessel of an embodiment of the present invention.

Gases and/or liquids exiting backpressure regulator 12 are transferred into low pressure separator 14 (which, in this embodiment, is heated) via flow line 13 (the complete operation of backpressure regulator 12 is further illustrated in FIG. 2).

Liquid level control 15 sends a pressure signal through tubing line 17 to open motor valve 16 and transfers produced liquids from intermediate pressure slug containing vessel 9 through line 18 into low pressure separator 14. Line 21 transfers produced liquids from low pressure separator 14 into storage tank 22. Line 23 transfers gases evolved from the liquids in storage tank 22 into the emissions separator (not shown) of VRSA 24.

Line 32 transfers the gases from low pressure separator 14 to the inlet of backpressure valve 33. Line 25 transfers the gases exiting back pressure valve 33 into the emissions separator (not shown) of VRSA 24. Line 26 preferably transfers the gases collected and compressed by VRSA 24 to the inlet of one of the high pressure separators. Transducer 27 measures the pressure in storage tank 22. Transducer 29 measures the pressure in emissions separator (not shown) of VRSA 24. Electrical line 30 connects transducer 27 to programmable logic controller ("PLC") 28. Electrical line 31 connects transducer 29 to PLC 28. I/P transducer (converting current input to pressure output) 34 may be installed to control the pressure signal either upstream of liquid level control 15 (as shown) or downstream of liquid level control 15 on tubing line 17. Electrical line 35 connects PLC 28 to I/P transducer 34. Tubing line 36 (see FIG. 2) carries a controlled pressure signal from I/P transducer 34 to the supply gas inlet of liquid level control 15.

FIG. 2 is a schematic of a configuration of an embodiment of intermediate pressure slug containing vessel 9. Intermediate pressure vessel 9 is illustrated as a horizontal vessel (the preferred design) with liquid accumulator section 42 (a first boot) and gas dome 43 (a second boot).

Liquid accumulator section 42 extends downwardly from the bottom of intermediate pressure slug-containing vessel 9, through the top of low pressure separator 14 and into heated liquid contained in low pressure separator 14. Liquid accumulator section 42 contains liquid level control 15 and internal dump line 37 which extends downwardly from outlet connection 48 located at the top of intermediate pressure vessel 9 to a distance (e.g., approximately 2 inches) from the bottom of liquid accumulator section 42. Gas dome 43 extends upwardly a distance (e.g., approximately two feet) above the top of intermediate pressure vessel 9. Gas dome 43 has inlet connection 47 connected to line 10. Line 10 transfers the produced liquids from the high pressure separators to intermediate pressure slug containing vessel 9. Internally, gas dome 43 has line 44 which extends downwardly from outlet connection 46 to terminate at point 50. In a most preferred embodiment, point 50 is approximately four inches below inlet connection 47 and approximately four inches above the top of intermediate pressure slug containing vessel 9. The outlet of connection 46 is connected by line 11 to the inlet of back pressure regulator 12. Back pressure regulator 12 senses, through tubing line 38, the gas pressure contained in intermediate pressure slug containing vessel 9.

The specific operation of intermediate pressure slug containing vessel 9 is as follows. The operation of intermediate pressure slug containing vessel 9 begins when produced liquids are dumped from high pressure separators 7 and 8 into intermediate pressure slug containing vessel 9. The pressure in intermediate pressure slug containing vessel 9 is controlled by backpressure regulator 12 to maintain an intermediate pressure of, for example, from approximately 75 to 150 psig between the operating pressure of high pressure separators 7 and 8 and low pressure separator 14. The pressure settings of backpressure regulators 12 and 33 are determined by the lowest expected flowing line pressure in the high pressure separators. The change of pressure between the high pressure separators and intermediate pressure slug containing vessel 9 causes entrained gases and some liquid flashing to occur in intermediate pressure slug containing vessel 9.

As soon as the gas pressure in intermediate pressure slug containing vessel 9 reaches the set pressure of back pressure regulator 12, gas will begin to flow through back pressure regulator 12 into low pressure separator 14. The produced liquids entering intermediate pressure slug containing vessel 9 will fall to the bottom and begin filling liquid accumulator section 42.

If the output through electric line 35 from PLC 28 to I/P transducer 34 (such transducers convert current input to a proportional pressure output) shows that VRSA 24 can handle the vapors generated by the liquids entering intermediate pressure slug containing vessel 9, liquid level control 15 will open dump valve 16, and through lines 37, 49, and 18, cause the produced liquids to flow into low pressure separator 14.

If the volume of vapors from the produced liquids entering intermediate pressure vessel 9 begin to overload the vapor capacity of VRSA 24, PLC 28 will send a signal to I/P transducer 34 to begin closing dump valve 16. As long as the volume of produced liquids entering intermediate pressure slug containing vessel 9 continue to generate enough vapors to overload the capacity of VRSA 24, PLC 28 through I/P transducer 34 will continue to close dump valve 16.

Keeping dump valve 16 closed will cause intermediate pressure slug containing vessel 9 to begin filling with produced liquids. Intermediate pressure slug containing vessel 9 preferably has several barrels of fluid capacity and is designed to store excess produced liquids so they can be dumped over an extended period of time to match the vapor capacity of VRSA 24. In case of a mechanical failure or other unexpected occurrence, line 44 is designed to prevent overfilling of intermediate pressure slug containing vessel 9. Anytime bottom 50 of line 44 becomes covered with produced liquids, the produced liquids will flow with the released vapors through lines 44, 11, and 13 and back pressure valve 12 into low pressure separator 14. Produced liquids flowing through back pressure valve 12 would be an upset operating condition.

Referring again to FIG. 2, low pressure separator 14, can be either two or three-phased. Low pressure separator 14 has fire tube 39 to provide heat to the system. The bottom end of emission separator 45 (a component of VRSA 24) is immersed in the heated liquids contained in low pressure separator 14. Also, two pipe coils 40 and 41 are immersed in the liquids contained in low pressure separator 14. As required to control the temperature of control gas entering the emissions separator or the stages of compression, additional coils could be installed in the low-pressure separator.

Figure 3:
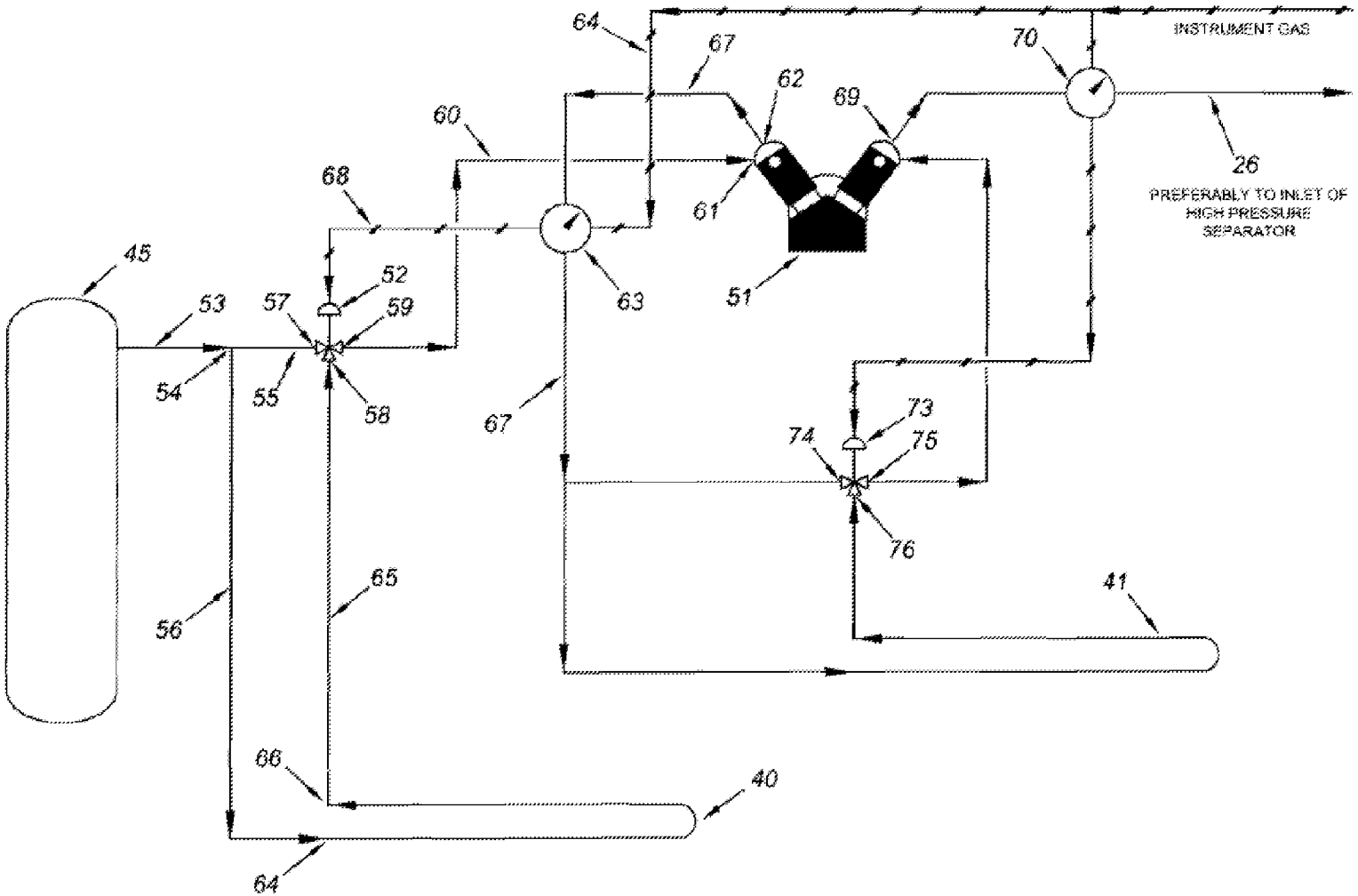
FIG. 3 is a schematic showing the operation of pipe coils of an embodiment of the present invention.

FIG. 3 is a schematic illustrating the operation of pipe coils 40 and 41. As previously described, both pipe coils 40 and 41 are immersed in the produced liquids contained in low pressure separator 14. The purpose of pipe coils 40 and 41 is to control the gas discharge temperature of both stages of two-stage compressor 51. Controlling the gas discharge temperatures of two-stage compressor 51 provides successful operation of VRSA 24. If the gas discharge temperature is too low (below, for example, 170 degrees Fahrenheit after the first stage of compression), condensation of the collected vapors could occur in the first stage compressor cylinder and lead to rapid mechanical failure of the compressor. If the discharge gas temperature is too high (for example, 300 degrees Fahrenheit or above after the second stage of compression), mechanical failure of the compressor could also occur.

Referring again to FIG. 3, pipe coil 40 is a heating coil immersed in the produced liquids contained in low pressure separator 14. Pipe coil 40 is designed to heat, if necessary, the collected vapors exiting emission separator 45 prior to the vapors entering first compression stage 62 of two-stage compressor 51. Flow line 53 splits at point 54 into flow lines 55 and 56. Flow line 55 connects from point 54 to one inlet port 57 of three-way valve 52 (commonly referred to as a splitter valve). Flow line 56 connects from point 54 to inlet 64 of heating coil 40. Flow line 65 connects from outlet connection 66 of heating coil 40 to a second inlet port 58 of three-way valve 52. Flow line 60 connects from common port 59 of three-way valve 52 to inlet port 61 of first stage of compressor 51. Component 63 may be either a transducer utilized to control an UP or a throttling indirect acting thermostat (as temperature falls, output increases) that senses the temperature of the discharge gas exiting the first stage of compression 62. Instrument gas supply line 64 is illustrated leading to component 63. Tubing line 68 carries the output signal from component 63 (in this embodiment, a throttling thermostat) to the diaphragm of three-way valve 52.

As previously described, to prevent condensation of the collected vapors, it is necessary to maintain the temperature of the gas exiting first compression stage 62 at approximately 170 degrees Fahrenheit or above. If thermostat or transducer 63 senses that the discharge gas temperature in flow line 67 is too cool, it will send a pressure signal to first three-way valve 52 to begin closing the gas flow between inlet port 57 and common port 59. Decreasing the proportion of the gas flow between ports 57 and 59 will cause the balance of the gas flowing through line 53 to flow through heating coil 40 where it collects heat prior to entering port 58 of three-way valve 52. In three-way valve 52, the cool gas from port 57 will mix with the heated gas from port 58 to maintain an adequate temperature of the gas entering at inlet port 61 the first stage of compression 62 to provide the desired gas discharge temperature of approximately 170 degrees Fahrenheit or above in flow line 67. Under most operating conditions, it is anticipated that, because of compression, the temperature of the discharge gas in flow line 67 will be in the range of about 200 degrees Fahrenheit; therefore, heating coil 40 will only be required to provide heat to the gas in flow line 60 when very cold ambient temperatures are encountered.

Cooling coil 41 is immersed in the produced fluids contained in low pressure separator 14. Cooling coil 41 uses the fluids in low pressure separator 14 as a heat sink to cool, when required, the hot gases exiting from first stage of compression 62 before the hot gases enter the second stage of compression 69. As previously described to prevent damage to compressor 51, it is necessary to keep the maximum temperature of the gas exiting the second stage of compression 69 of compressor 51 below approximately 300 degrees Fahrenheit. Cooling coil 41 mirrors the operation of heating coil 40. The only change is that component 70 (a thermostat or transducer and UP) which senses the temperature of the gas in discharge flow line 26 is direct acting (as temperature rises, output increases) and the action of second three-way valve 73 becomes the reverse of the action of first three-way valve 52. The gas flowing from port 74 to port 75 is hot. The gas flowing from port 76 to port 75 is cooled. Component 70 (which again, is a thermostat or transducer and I/P) opens and closes three-way valve 73 to maintain the desired temperature of approximately 270 degrees Fahrenheit in discharge flow line 26. Flow line 26 preferably transfers the collected and compressed vapors to the inlet of one of the high pressure separators. Unlike prior art systems, embodiments of the present invention thus provide the ability to accurately control the temperature of gas entering and passing through the compressor regardless of what the ambient temperature is or even if the ambient temperature fluctuates over a large range.

By pre-heating the gas flowing into the inlet to the first stage of the compression, the gas is maintained in a gaseous state. By cooling the gas after compression by the first stage, the gas is allowed to enter the second stage of compression at a temperature low enough to ensure that damage to the compressor does not occur because of excess gas temperature during compression of the gas in the second stage of the compressor. Thus, embodiments of the present invention not only ensure that the gas is maintained at a temperature that prevents condensation and/or liquification of the gas, but also maintains the gas at a temperature low enough to prevent thermal damage to the compressor.

The present invention not only provides more desirable results than prior art systems, but also provides desirable results using less energy because the heat transferred from the hot gas to the produced liquid decreases the amount of fuel, gas, or other energy source required to maintain the produced liquids at the desired bath temperature.

The preceding examples can be repeated with similar success by substituting the generically or specifically described components and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above, and of the corresponding application(s), are hereby incorporated by reference.

What is claimed is:

1. A method for handling a liquid hydrocarbon slug comprising the steps of:

connecting a liquid hydrocarbon slug-containing vessel in communication with a natural gas well for receiving produced liquids; and connecting a liquid level control in communication with a vapor recovery process system to cause the produced liquids to flow to the vapor recovery process system when the vapor recovery process system can accommodate vapors derived from the liquid hydrocarbons.

2. The method of claim 1 further comprising the step of disposing a high pressure separator between, and in communication with, the natural gas well and the liquid hydrocarbon slug-containing vessel.

3. The method of claim 1 further comprising the step of disposing a low pressure separator between, and in communication with, the liquid hydrocarbon slug-containing vessel and the vapor recovery process system.

4. An apparatus for containing a slug of liquid hydrocarbons collected in a natural gas well production unit or separator, said apparatus comprising:

a vessel;

a liquid accumulator section of said vessel in communication with a low pressure separator;

a liquid level control connected to said liquid accumulator section, said liquid level control sending a flow of liquid hydrocarbons to said low pressure separator when a vapor recovery process system can receive gaseous hydrocarbons; said liquid level control restricting the flow of liquid hydrocarbons to said low pressure separator when a volume of vapors from produced liquids begin to overload a capacity of said vapory recovery process; and a gas container in communication with a high pressure separator.

5. The apparatus of claim 4 further comprising a heating coil in said low pressure separator, said heating coil heating a gas entering a first stage of a compressor when a temperature of the gas is cooler than desired.

6. The apparatus of claim 5 further comprising an output signal component in communication with the gas entering said first stage of said compressor.

7. The apparatus of claim 6 wherein said output signal component comprises a transducer.

8. The apparatus of claim 6 wherein said output signal component comprises a thermostat.

9. The apparatus of claim 5 further comprising a cooling coil in said low pressure separator, said cooling coil cooling a gas discharged from said first stage of said compressor when a temperature of the gas discharged by said first stage is hotter than desired.

10. The apparatus of claim 9 further comprising a second output signal component in communication with the discharge gas exiting said first stage of said compressor and sensing whether the discharge gas is too hot.

11. The apparatus of claim 10 wherein said second output signal component comprises a transducer.

12. The apparatus of claim 10 wherein said second output signal component comprises a thermostat.

13. The apparatus of claim 5 further comprising control logic configured to cause said heating coil to heat the gas entering said first stage of said compressor if a temperature of the gas entering said first stage is less than or about the same as a temperature at which the gas liquefies or condenses.

14. The apparatus of claim 9 further comprising control logic configured to cause said cooling coil to cool the gas discharged from said first stage of said compressor if the temperature of the gas is greater than or about at a temperature at which compression of the gas by said second stage of said compressor would result in a temperature at or above that which would cause thermal damage to said compressor.

15. The apparatus of claim 5 further comprising a cooling coil in said low pressure separator, said cooling coil cooling a gas discharged from said first stage of said compressor when a temperature of gas discharged from said second stage is hotter than desired.

16. The apparatus of claim 15 further comprising a second output signal component in communication with the discharge gas exiting said second stage of said compressor and sensing whether the discharge gas is too hot.

17. The apparatus of claim 15 further comprising control logic configured to cause said cooling coil to cool the gas discharged from said first stage of said compressor when the gas discharge temperature of said second stage is greater than a predetermined amount.

18. The apparatus of claim 17 wherein said predetermined amount is less than a temperature at which thermal damage to said compressor occurs.

19. The apparatus of claim 5 further comprising fluids disposed in said low pressure separator which fluids act as a heat sink to cool the hot gases exiting from said first stage of said compressor before the hot gases enter a second stage of said compressor.

* * * * *